US005520714A

United States Patent [19]

Muschelknautz

[11] Patent Number: 5,520,714

[45] Date of Patent: May 28, 1996

[54] LIQUID SEAL APPARATUS

[75] Inventor: Sebastian Muschelknautz, München, Germany

[73] Assignee: Linde Aktiengesellschaft, Germany

[21] Appl. No.: 306,826

[22] Filed: Sep. 15, 1994

[30] Foreign Application Priority Data

Sep. 17, 1993 [DE] Germany ..... 43 31 685.9

[51] Int. Cl.[6] ..... B01D 45/08

[52] U.S. Cl. ..... 55/256; 55/257.1; 95/226; 261/123

[58] Field of Search ..... 55/255, 256, 257.1; 95/226; 261/121.1, 123, 126

[56] References Cited

U.S. PATENT DOCUMENTS

| | | | |
|---|---|---|---|
| 3,456,709 | 7/1969 | Vegeby | 55/257.1 X |
| 4,005,999 | 2/1977 | Carlson | 95/226 X |
| 4,190,629 | 2/1980 | Strachan | 55/256 X |
| 4,290,784 | 9/1981 | Rawicki | 261/123 X |
| 4,300,924 | 11/1981 | Coyle | 55/255 X |
| 4,494,963 | 1/1985 | Reich | 55/256 X |
| 4,650,497 | 3/1987 | Quintana | 55/256 X |
| 4,778,483 | 10/1988 | Martin et al. | 55/256 X |

FOREIGN PATENT DOCUMENTS

| | | | |
|---|---|---|---|
| 738641 | 6/1980 | U.S.S.R. | 55/256 |

*Primary Examiner*—Richard L. Chiesa
*Attorney, Agent, or Firm*—Webb Ziesenheim Bruening Logsdon Orkin & Hanson

[57] ABSTRACT

A liquid seal for installation upstream of a flare stack or of a waste gas combustion installation to protect against flash-back and to function as a pressure lock. During the operation of the seal, liquid is ejected upwardly from an inner annular chamber by a gas stream, and the ejected liquid is separated from the gas by a baffle plate and deflector arrangement so that the gas and liquid stream is directed downwardly, and a liquid film is formed which is broken down into individual streams by baffles. The gas escapes upwardly from the liquid seal in spaces between the streams of downwardly flowing liquid without entraining significant amounts of liquid. The downwardly directed liquid is collected in an outer annular chamber and flows into the inner annular chamber through a return opening to provide a constant circulation of liquid in the liquid seal.

16 Claims, 1 Drawing Sheet

LIQUID SEAL APPARATUS

BACKGROUND OF THE INVENTION

1. Field of the Invention

The invention relates generally to a liquid seal and to a method for operating a liquid seal which is located upstream of a flare stack or of a waste gas combustion system, wherein a stream of gas is introduced into the liquid seal by a gas delivery tube having an outlet end submerged in a dammed-up liquid contained in the seal.

2. Description of Prior Art

Liquid seals are conventionally installed upstream of flare stacks or waste gas combustion installations for safety reasons. A liquid seal is intended to serve a dual purpose. On one hand, the seal provides protection against a flashback, and on the other hand the seal functions as a pressure lock for the gas stream. Prior art liquid seals do not perform these dual functions satisfactorily because fluctuations occur in the level of the liquid in the liquid seal which result in gas pulsations and/or the ejection of liquid from the liquid seal. The ejection of liquid is undesirable because it causes the liquid, which is generally water, to contact the flare stack where it adversely affects combustion. The maintenance of pressure by using a liquid seal as a pressure lock is necessary to prevent oxygen from entering the system upstream of the liquid seal. Gas pulsations which occur in the liquid seals of the prior art significantly interfere with the combustion at the flare stack or in the waste gas combustion installation and threaten the operational safety of the system.

SUMMARY OF THE INVENTION

Objects of the invention are a liquid seal which prevents the escape of liquid from the liquid seal by means of an almost 100% separation of the liquid from the gas stream passing through the liquid seal and the method of operating such a liquid seal. An additional object of the invention is the effective prevention of pulsations of the gas stream passing through the seal.

These objects are accomplished according to the invention by the operation of a liquid seal in accordance with the following method:

a) Discharging a gas stream from the lower end of a submerged tube into dammed-up liquid in the liquid seal.

b) Deflecting the gas stream by the dammed-up liquid in the liquid seal to change the direction of flow by an angle between about 160° and about 200°, preferably 180° so that liquid is carried off by the gas stream, and impairting a swirling motion to the resulting gas and liquid stream.

c) Transporting the resulting gas and liquid stream to contact a baffle arrangement having a plate and a deflector collar to change the direction of flow of the stream by an angle between about 140° and about 200°, preferably 180°.

d) Forming a liquid film as a result of the change of direction of flow of the stream.

e) Separating the liquid film into individual streams of liquid by baffles.

f) Directing the individual streams of liquid into a collecting space in the liquid seal.

g) Reversing the direction of flow of the gas stream by an angle of about 180° so that the stream flows upwardly through spaces between the streams of liquid and passes out of the liquid seal.

A modification of the method of the invention includes the step of:

importing a rotary motion to the resulting gas and liquid stream as it is discharged from the lower end of the submerged pipe.

It has been determined that in spite of the relatively simple operation of the liquid seal of the invention, an almost complete separation of liquid from the stream of gas flowing through the seal from a flare stack or from a waste gas combustion installation can be achieved. The separation of the liquid from the gas is essentially achieved by deflecting the direction of flow of the stream containing gas and liquid. The result is the formation of a liquid film which is separated into individual streams of liquid, so that the liquid is not re-atomized by the gas which is discharged upwardly out of the gas seal. To increase the degree of the separation of the liquid from the gas, the method of the invention takes advantage of the fact that the individual streams of liquid absorb and collect liquid droplets which are entrained in the gas stream, while at the same time the gas stream flows upwardly, out of the liquid seal through spaces between the streams of liquid without removing a significant amount of liquid from the liquid seal.

During the operation of the liquid seal of the invention, it must be understood that over a finite period of time, the liquid ejected from the dammed-up liquid contained in the liquid seal by the gas stream is removed from the collecting chamber. At the same time, to effectively maintain the pressure lock, a substantially identical amount of liquid must be introduced into the dammed-up liquid at the lower end of the gas delivery tube. This return current is achieved by a hydrostatic pressure increase in the collecting chamber. Circulation of the liquid inside the liquid seal is advantageously maintained by the liquid entrained in the gas stream and by a return flow into the dammed-up liquid.

This method of operation of the liquid seal has the advantage that the circulation of the liquid is self-regulating. The self-regulation is accomplished by having the streams of liquid discharge into an outer annular chamber in the liquid seal. The liquid flows from the lower end of the outer annular chamber into a reservoir and from the reservoir through at least one return opening or pipe into an inner annular chamber where the gas stream is guided from the lower end of the gas delivery tube toward the liquid. As a result of its inertia, a liquid circulation system operated in this manner effectively prevents fluctuation of the liquid levels in the inner and outer annular chambers of the seal which prevents a pulsing gas discharge from the liquid seal which would be caused by the fluctuation of the levels of liquid in the inner and outer annular chambers.

The baffles which create the streams of liquid advantageously function as deflector plates. The streams of liquid are created by a plurality of rows of individual deflector plates, although two rows are preferred. The rows of deflector plates are vertically separated so that the streams of liquid created by the deflector plates in the first row of deflector plates contact the deflector plates in the adjacent row of deflector plates which is located below the first row. This will be accomplished if the streams of liquid which originate at the first row of deflector plates which pass to the penultimate rows of deflector plates in the direction of flow are guided to the next row of deflector plates in the direction of flow. This arrangement of the deflector plates results in a good separation of the gas and liquid stream into the liquid phase and the gas phase with low friction. A high degree of liquid/gas separation is guaranteed within the liquid seal with a relatively low pressure loss.

In a refinement of the invention, the gas stream is guided toward the dammed-up liquid at the lower end of the gas delivery tube through a plurality of tooth-shaped openings formed in the lower end of the tube in a saw tooth profile. The advantage of this step becomes clear if the liquid seal is operated with gas streams having different velocities. When no gas is flowing through the seal, a uniform liquid level is established in the inner and outer annular chambers. When gas flow is initiated and is still relatively slow, the liquid level in the inner annular chamber falls until the first gas bubbles can escape from the corners of the saw teeth in the lower end of the gas delivery tube. As a result of the volume of the ascending gas bubbles, the level of the mixture in the inner annular chamber increases above the level of the liquid in the outer annular chamber. When the liquid seal is operated with an intermediate gas flow, a major portion of the liquid from the inner annular chamber is displaced into the outer annular chamber, whereby as a result of the hydrostatic pressure in the outer annular chamber, the liquid flows back through the return openings into the inner annular chamber. The result is a pulsation-free operation of the liquid seal.

Above a maximum gas flow, the dynamic pressure of the gas at the return openings is so great that the circulating liquid is dammed up and can no longer flow back through the return openings into the inner annular chamber. The gas can then flow through the liquid seal without liquid and with a low pressure loss. As a result of the saw tooth openings on the lower end of the gas delivery tube, even at relatively low gas flows, it is possible to reach the operating conditions of an intermediate gas stream, where the level of liquid in the outer annular chamber is higher than the level of liquid in the inner annular chamber.

In another embodiment of the invention, a swirling motion of the gas stream is created by positioning the saw tooth openings on the lower end of the gas delivery tube in a helical configuration. Such a configuration assists the subsequent separation into the gas and liquid phases.

In an additional embodiment of the method of the invention, the liquid seal is operated so that the charge of the gas and the liquid in the stream, i.e., the ratio of the mass of the liquid to the mass of the gas is between about 3 and about 5.

The liquid seal of the invention includes a centrally located vertical gas delivery tube having a lower end located in an inner annular chamber. The inner annular chamber is surrounded by a cylindrical guide tube which extends downwardly below the lower end of the gas delivery tube to the bottom wall of the liquid seal. A baffle plate is located at the upper end of the gas delivery tube and is oriented at an angle between about 70° and about 110°, preferably 90°, to the vertical axis of the gas delivery tube. A substantially vertical annular deflector collar depends from the outer edge of the baffle plate. The deflector collar is oriented at an angle between about 70° and about 110°, preferably 90°, to the plane of the baffle plate. One or more vertically spaced rows of baffles are attached to the inner surface of the deflector collar to create different streams of liquid. An outer annular collecting chamber is located at the lower end of the liquid seal and is defined on the outside by the external shell of the liquid seal and on the inside by the outer surface of the cylindrical guide tube. Liquid openings connect the outer annular collecting chamber and the inner annular chamber.

The liquid seal of the invention has a relatively simple construction, so that it can be easily modified to meet the requirements of special applications when necessary. In particular, it is possible to calculate or to accurately estimate the pressure loss which will occur in the liquid seal for a specified gas flow and liquid charge. Such calculations significantly improve the operational safety of the installation.

In another embodiment of the invention, the liquid seal baffles are symmetrically-oriented deflector plates having an inverted "V" shape with an included angle between about 15° and about 90°, preferably between about 20° and about 40°. Additionally, the advantages of the liquid seal are enhanced if the lower end of the gas delivery tube has a saw tooth profile, and the saw teeth are oriented at an angle relative to the vertical axis of the tube to impart a swirling motion to the gas stream discharged therefrom.

In the liquid seal of the invention, the inner annular chamber has a flow connection to the collecting chamber by at least one return opening, which is preferably a centrally located return pipe. When a centrally located return pipe is used, the exterior of the pipe will form the inner wall of the inner annular chamber. The diameter of the return opening or of the return pipe will advantageously be between about 20% and about 50%, preferably between about 30% and about 40%, of the diameter of the gas delivery tube.

In a further embodiment of the liquid seal of the invention, the inner annular chamber and the collecting chamber are not directly connected. Rather, the return openings or the return pipe are a part of a partition which, together with the inner surface of the guide tube and the upper surface of the bottom wall of the seal, forms a reservoir having openings to the outer annular chamber. In this embodiment, the collecting chamber is divided into the outer annular chamber and a central reservoir in flow connection therewith. This arrangement is shown in the drawing figure wherein the guide tube is extended to the base of the liquid seal. In this manner, as a result of the increased damping of fluctuations, the danger of fluctuations of the level of the liquid in the liquid seal is effectively prevented. It has been found to be particularly effective to use openings in the form of slots or rows of holes located in the lower end of the guide tube to connect the reservoir and the outer annular chamber. The total surface area of the openings in the lower end of the guide tube is preferably 1 to 5 times greater than the surface area of the cross section of the return opening or of the return pipe in the partition. In any event, the return opening or the return pipes acts to damp the fluctuations of the levels of the liquid in the inner and outer annular chambers.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
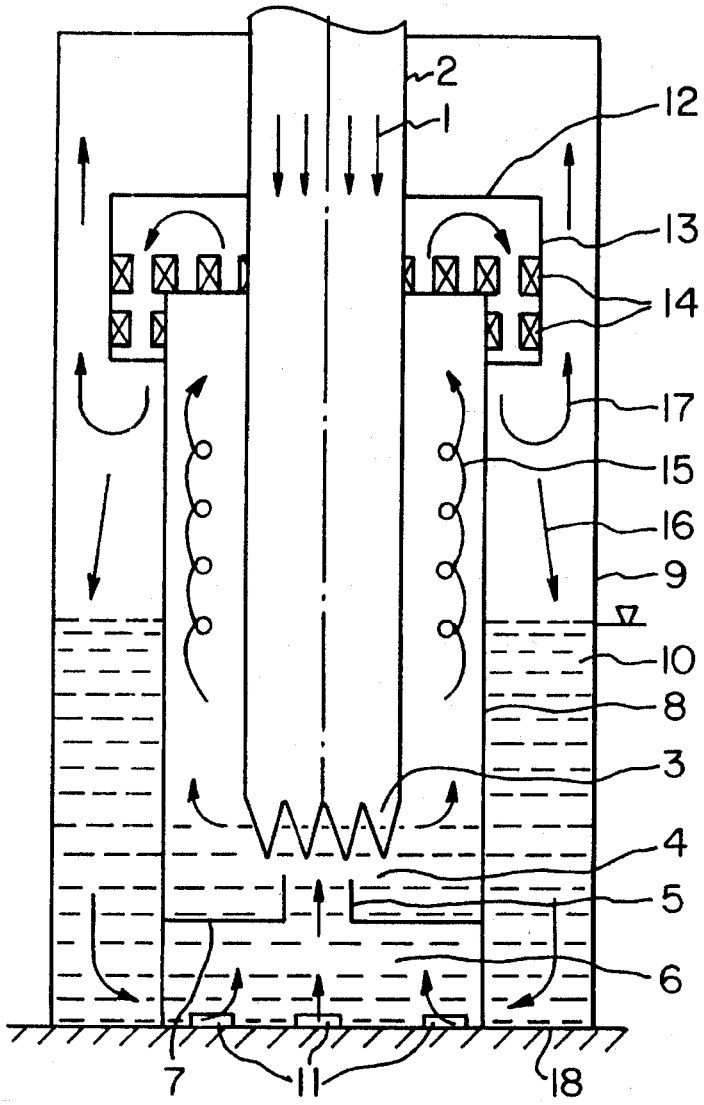
FIG. 1 shows a schematic longitudinal section through the liquid seal of the invention.

As shown in FIG. 1 of the drawings, a gas stream shown by arrows 1 is introduced into the liquid seal through a substantially vertical gas delivery tube 2 which is centrally located in the liquid seal and has its lower end positioned within the lower portion of the liquid seal. The pressure of the gas passing through gas delivery tube 2 maintains the level of the liquid in an inner annular chamber 4 below the level of the liquid in an outer annular chamber 10 which level is maintained by an intermediate gas pressure. The direction of the gas stream is reversed by approximately 180° as it exits the lower end of gas delivery tube 2 through the openings between saw teeth 3 which are formed on the lower end of tube 2. Liquid in inner annular chamber 4 is entrained in the gas stream exiting tube 2 and is transported upwardly as shown by arrows 15.

The liquid flows upwardly, partly under the action of the slowly rotating gas stream, to form a film on the inner surface of the wall of a guide pipe 8. Droplets of liquid are absorbed by the gas stream to form a mixed stream of gas and liquid which strikes the lower surface of a baffle plate 12 which is oriented at an angle between about 70° and about 110° to the longitudinal axis of tube 2 at a relatively high velocity. Baffle plate 12 is shown at about a 90° angle to the longitudinal axis of gas delivery tube 2 in FIG. 1 of the drawings. Baffle plate 12 has an annular depending deflector collar 13 connected to its outer edge. Deflector collar 13 extends downwardly from baffle 12 substantially parallel to the longitudinal axis of tube 2, i.e., at a 90° angle to the baffle. However, the deflector collar may be positioned at an angle between about 70° and about 90° to the baffle. Two vertically spaced rows of baffles 14 are mounted on the inner surface of deflector collar 13. The direction of flow of the gas and liquid stream is changed by approximately 180° by contact with baffle plate 12 and deflector collar 13 and causes a liquid film to form which is broken down into individual streams of liquid by baffles 14 which function as flow separators.

Figure 2:
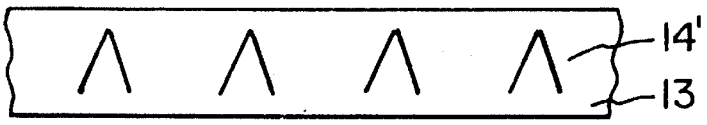
FIG. 2 is an elevation showing the details of the inverted "V" shaped baffles.

As shown in FIG. 2 of the drawings, it is preferred that the baffles 14' in each of the vertically spaced rows have an inverted "V" shape. It is preferred that the included angle for each baffle is between about 15° and about 90° with the optimum included angle being between about 20° and about 40°.

The gas escapes upwardly through the liquid seal in the spaces between the streams of liquid in the direction of arrows 17 almost: unhindered, with a low pressure loss, and without entraining any liquid. The streams of liquid, as a result of the force of gravity and the conservation of momentum, flow downwardly as shown by arrows 16 into liquid which has collected in outer annular collecting chamber 10. The streams of liquid essentially flow downwardly along the outer shell 9 of the liquid seal into the liquid in the outer annular chamber. The phase separation which takes place results in a nearly pulsation-free operation of the liquid seal. The liquid travels from outer annular chamber 10 into a reservoir 6 through a plurality of openings or slots 11 located in the lower end of guide tube 8. The upper end of reservoir 6 is closed by a partition 7 and the liquid flows from reservoir 6 into inner annular chamber 4 through return openings or through a return pipe 5 located at the center of the partition. Outer annular chamber 10 and reservoir 6 are closed on the lower end by bottom wall 18 of the oil seal.

Figure 3:
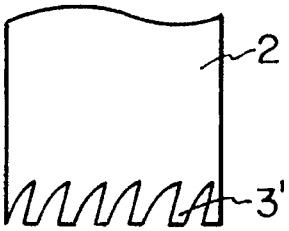
FIG. 3 is an elevation of a second embodiment of the lower end of the discharge pipe.

In the embodiment of the invention shown in FIG. 3 of the drawings, the saw teeth 3' at the lower end of discharge tube 2 are formed with a helical shape so that the individual openings impart a strong rotary motion to the gas as it is discharged from the tube into the dammed-up liquid in inner annular chamber 4.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A liquid seal having an outer shell and a centrally located substantially vertical gas delivery tube having a lower discharge end, means including a guide tube extending below said lower discharge end of said gas delivery tube forming an inner annular chamber in said liquid seal surrounding said lower discharge end of said gas delivery tube for containing dammed-up liquid, a first baffle means connected to said gas delivery tube above said lower discharge end, a depending deflector collar connected to said first baffle means and having an inside surface, a second baffle means attached to said inside surface of said deflector collar for generating independent streams of liquid, a collecting chamber formed by said outer shell of said liquid seal, and means for providing flow communication between said inner annular chamber and said collecting chamber, whereby liquid can flow between said collecting chamber and said inner annular chamber.

2. A liquid seal as set forth in claim 1, wherein said first baffle means is oriented at an angle between about 70° and about 110° to the vertical axis of said gas delivery tube.

3. A liquid seal as set forth in claim 1, wherein said first baffle means is oriented at an angle of about 90° to the vertical axis of said gas delivery tube.

4. A liquid seal as set forth in claim 1, wherein said deflector collar extends downwardly from said first baffle means at an angle between about 70° and about 110°.

5. A liquid seal as set forth in claim 1, wherein said deflector collar depends downwardly from said first baffle means at an angle of about 90°.

6. A liquid seal as set forth in claim 1, wherein said second baffle means is a plurality of spaced rows of symmetrically oriented deflector plates fastened to said inside surface of said deflector collar.

7. A liquid seal as set forth in claim 6, wherein each of said symmetrically oriented deflector plates is in the shape of an inverted "V" having an included angle between about 15° and about 90°.

8. A liquid seal as set forth in claim 7, wherein said included angle is between about 20° and about 40°.

9. A liquid seal as set forth in claim 1, wherein said lower end of said gas delivery tube is formed with a plurality of individual teeth arranged in a saw tooth profile to define discharge openings at said lower end of said gas delivery tube.

10. A liquid seal as set forth in claim 9, wherein said individual teeth in said saw tooth profile have an angular helical orientation, whereby a rotary motion is imparted to gas exiting from said lower end of said gas delivery tube.

11. A liquid seal as set forth in claim 1, wherein said means for providing flow communication between said inner annular chamber and said collecting chamber is a return pipe.

12. A liquid seal as set forth in claim 1, wherein the diameter of said means for providing flow communication between said inner annular chamber and said collecting chamber is about 20% to about 50% of the diameter of said gas delivery tube.

13. A liquid seal as set forth in claim 12, wherein said diameter of said means for providing flow communication between said inner annular chamber and said collecting chamber is about 30% to about 40% of the diameter of said gas delivery tube.

14. A liquid seal as set forth in claim 1, including a partition forming a reservoir with said guide tube below said inner annular chamber and said means for providing flow communication is formed in said partition, and a plurality of openings at the lower end of said guide tube connecting said reservoir to said outer annular chamber.

15. A liquid seal as set forth in claim 14, wherein said plurality of openings connecting said reservoir and said outer annular chamber are slots.

16. A liquid seal as set forth in claim 14, wherein the entire surface area of said plurality of openings is 1 to 5 times greater than the area of the cross section of said means for providing flow communication formed in said partition.

* * * * *